US011639824B2

(12) United States Patent
Moyle et al.

(10) Patent No.: US 11,639,824 B2
(45) Date of Patent: May 2, 2023

(54) PROCESS FOR ENHANCED CLOSED-CIRCUIT COOLING SYSTEM

(71) Applicant: Air Products and Chemicals, Inc., Allentown, PA (US)

(72) Inventors: Todd M. Moyle, Allentown, PA (US); Xukun Luo, Allentown, PA (US)

(73) Assignee: Air Products and Chemicals, Inc., Allentown, PA (US)

( * ) Notice: Subject to any disclaimer, the term of this patent is extended or adjusted under 35 U.S.C. 154(b) by 13 days.

(21) Appl. No.: 16/862,839

(22) Filed: Apr. 30, 2020

(65) Prior Publication Data

US 2021/0341222 A1 Nov. 4, 2021

(51) Int. Cl.
*F25J 1/00* (2006.01)
*F25J 1/02* (2006.01)

(52) U.S. Cl.
CPC ..... *F25J 1/0097* (2013.01); *F25J 1/0205* (2013.01)

(58) Field of Classification Search
CPC .. F25J 1/00; F25J 1/0012; F25J 1/0022; F25J 1/0097; F25J 1/0205; F28F 27/03; F25D 1/00; F25D 1/0233; F25D 1/024; F25D 1/06; F25D 1/05316; F28D 3/00;
(Continued)

(56) References Cited

U.S. PATENT DOCUMENTS 4,362,462 A * 12/1982 Blotenberg ..... F04D 29/5833 415/1
5,067,322 A * 11/1991 Beers ..... F28F 1/36 165/184
(Continued)

FOREIGN PATENT DOCUMENTS

CN 1405523 A 3/2003
CN 104632585 A 5/2015
(Continued)

OTHER PUBLICATIONS

Lin, Paul, et al; How Higher Chilled Water Temperature can Improve Data Center Cooling System Efficiency; Schneider Electric—Data Center Science Center White Paper 227, Rev 0, May 2018.
(Continued)

*Primary Examiner* — Miguel A Diaz
(74) *Attorney, Agent, or Firm* — Matthew Richard Weaver

(57) ABSTRACT

An apparatus and method for cooling a gas stream is provided comprising at least one heat exchanger in which a gas stream is cooled against a cooling liquid, whereby the cooling liquid temperature increases from a first temperature to a second temperature, at least one air cooler for cooling the cooling liquid after passing though the at least one heat exchanger, surface area of the at least one air cooler being designed to decrease temperature of the cooling liquid to the first temperature; a pump; and conduits to form a closed-circuit for the cooling liquid to pass continuously through the at least one heat exchanger and the at least one air cooler. The ratio of surface area of the at least one air cooler to the surface area of the at least one heat exchanger is optionally 12 or lower, and the difference of temperature between the second temperature and first temperature being greater than 15° C.

26 Claims, 3 Drawing Sheets

(58) Field of Classification Search
CPC ..... F28D 5/00; F25B 2313/003; F25B 2313/004; F25B 2339/047; F25B 9/004
See application file for complete search history.

(56) References Cited

U.S. PATENT DOCUMENTS

| | | | | |
|---|---|---|---|---|
| 2003/0033831 | A1* | 2/2003 | Davies | F25J 3/04157 62/617 |
| 2009/0207564 | A1* | 8/2009 | Campbell | H05K 7/20836 361/688 |
| 2010/0193163 | A1* | 8/2010 | Rollins | F28B 1/06 165/121 |
| 2015/0237766 | A1 | 8/2015 | Ding et al. | |

FOREIGN PATENT DOCUMENTS

| | | | | |
|---|---|---|---|---|
| DE | 102004050182 | A1 * | 4/2006 | F02C 7/047 |
| EP | 0862717 | A1 | 9/1998 | |
| WO | 2011149487 | A2 | 12/2011 | |
| WO | 2018004701 | A1 | 1/2018 | |

OTHER PUBLICATIONS

Gupta, J.P.; Working with Heat Exchangers: Questions and Answers; New York Hemisphere; 1990.

* cited by examiner

PROCESS FOR ENHANCED CLOSED-CIRCUIT COOLING SYSTEM

TECHNICAL FIELD

The present disclosure relates to an apparatus and method for cooling a gas stream. Specifically, the apparatus and method involve a closed-circuit cooling liquid system for cooling a gas stream. More specifically, the closed-circuit cooling liquid system includes at least one heat exchanger in which a gas stream is cooled against a cooling liquid and at least one air cooler for cooling the cooling liquid after passing through the at least one heat exchanger. Also, the present disclosure describes a system including a compressor that compresses a gas stream that is cooled by the closed-circuit cooling liquid system.

BACKGROUND OF THE INVENTION

In the discussion of the background that follows, reference is made to certain structures and/or methods. However, the following references should not be construed as an admission that these structures and/or methods constitute prior art. Applicant expressly reserves the right to demonstrate that such structures and/or methods do not qualify as prior art.

In many industrial processes, cooling of a gas stream is required. For example, in air separation units, gas is compressed in compressors and then cooled in compressor intercoolers. Compressor intercoolers are typically cross-flow heat exchangers in which cooling liquid flows counter to the gas stream, such that heat from the gas stream passes to the cooling liquid. In turn, the cooling liquid increases in temperature and must be cooled prior to disposal or additional use in heat exchangers.

It is known to cool gas streams using cooling liquids. A typical method involves a heat exchanger in which a gas stream is cooled against a cooling liquid. Typically, water is used as a cooling liquid. Cooling water systems are typically designed as either single pass cooling water systems or open-circuit cooling water systems. Single pass cooling water systems are traditionally used for small plants that have minimal cooling demands due to the high water usage. Open-circuit cooling water systems are common for large plants and are comprised of a cooling tower which rejects heat to the atmosphere through evaporative cooling. However, in regions and climates which lack the water supply necessary to operate these systems, a closed-circuit cooling liquid system is employed. A closed-circuit cooling liquid system is comprised of an air-water heat exchanger where heat is rejected to the atmosphere through convection. In these systems, the return cooling liquid is pumped through exchanger tubes as heat is exchanged with air passing over the outside of the tubes. Air is forced through the exchanger using multiple fans in a forced or induced draft orientation.

Single pass cooling water systems require minimal capital cost but have larger cooling water demands and are not suited for large plants. The operating and capital costs of closed-circuit cooling liquid systems are typically much greater than that of the open-circuit cooling water system. This is due to the additional complexity of the air cooler and the lack of heat rejection through evaporation, resulting in larger equipment and greater footprint. Additionally, the lack of evaporative cooling requires additional air flow to provide the same cooling duty. This leads to significantly larger power consumption for a closed-circuit cooling liquid system.

In many cases, air flow for cooling the cooling liquid is provided via electrically driven fans. The increased power demand caused by such fans has a significant impact on the operational cost of the cooling system and overall plant.

Although there have been some attempts to find methods of designing closed-circuit cooling water systems, the overall cost and efficiency of the system has not been assessed. Many of the design parameters including air cooler layout, surface area, air flow, and footprint are adjusted to design the lowest cost solution for a given scenario. However, the adjustment of these parameters is completed independent of the design of the systems that utilize the cooling water. Accordingly, there remains a need for design schemes resulting in overall cost and efficiency gains in gas cooling systems.

BRIEF SUMMARY OF THE INVENTION

It is desired to provide a process design scheme which uses a closed-circuit cooling liquid system and whose overall design leads to a lower operating power demand and lower capital cost. In general, this leads to a discharge temperature from the heat exchangers, such as intercoolers and aftercoolers, that is hotter than that recommended in the literature.

In the past, processes with a hot discharge temperature have resulted in excessive water loss, corrosion, and fouling in the exchangers, regardless of whether a closed-circuit or open-circuit system is used. The inventors have discovered that through an integrated design scheme, it is possible to reduce the energy required to operate the cooling system as well as reduce the overall cost of the total cooling system.

The present disclosure provides apparatus and method for cooling a gas stream utilizing a closed-circuit cooling liquid system designed in a manner that leads to a lower operating power demand and a lower capital cost. The present disclosure also provides a system for cooling a gas stream heated via a compressor that includes at least one compressor intercooler within a closed-circuit cooling liquid system.

One aspect of the described invention includes an apparatus including at least one heat exchanger in which a gas stream is cooled against a cooling liquid, whereby the cooling liquid temperature increases from a first temperature to a second temperature; at least one air cooler for cooling the cooling liquid after passing though the at least one heat exchanger, surface area of the at least one air cooler being designed to decrease temperature of the cooling liquid to the first temperature; a pump for circulating the cooling liquid; and conduits to form a closed-circuit for the cooling liquid to pass continuously through the at least one heat exchanger and the at least one air cooler. A ratio of surface area of the at least one air cooler to the surface area of the at least one heat exchanger is optionally 12 or lower.

In embodiments of the apparatus, the ratio is optionally 9 or lower, optionally 6 or lower, or optionally 3 or lower.

In embodiments of the apparatus, the surface area of the at least one heat exchanger and flow rate created by the pump is designed to result in a difference of temperature between the second temperature and first temperature being greater than 15° C. In other embodiments of the apparatus, the difference of temperature is at least 20° C., at least 25° C., or at least 30° C.

In embodiments of the apparatus, at least 2, at least 3, at least 5, at least 10, at least 15, at least 20 heat exchangers are used.

In embodiments of the apparatus, the at least one heat exchanger is a compressor intercooler or aftercooler.

A further aspect of the instantly described invention includes a method including providing at least one heat exchanger in which a gas stream is cooled against a cooling liquid, whereby the cooling liquid temperature increases from a first temperature to a second temperature; providing at least one air cooler for cooling the cooling liquid after passing though the at least one heat exchanger; providing a pump for circulating the cooling liquid; providing conduits to form a closed-circuit for the cooling liquid to pass continuously through the at least one heat exchanger and the at least one air cooler; pumping the cooling liquid through the closed-circuit at a flow rate that results in a difference of temperature between the second temperature and first temperature being greater than 15° C.; and powering the at least one air cooler to produce a cooling effect on the cooling water sufficient to decrease the temperature of the cooling liquid to the first temperature.

In embodiments of the method, the difference of temperature is at least 20° C., at least 25° C., or at least 30° C.

In embodiments of the method, a ratio of surface area of the at least one air cooler to the surface area of the at least one heat exchanger is optionally 12 or lower. In further embodiments, the ratio is optionally 9 or lower, optionally 6 or lower, or optionally 3 or lower.

In embodiments of the method, at least 2, at least 3, at least 5, at least 10, at least 15, at least 20 heat exchangers are used.

In embodiments of the method, the at least one heat exchanger is a compressor intercooler or aftercooler.

An aspect of the described invention includes a system including at least one compressor; at least one heat exchanger in which a gas stream compressed in the at least one compressor is cooled against a cooling liquid, whereby the cooling liquid temperature increases from a first temperature to a second temperature; at least one air cooler for cooling the cooling liquid after passing though the at least one heat exchanger, surface area of the at least one air cooler being designed to decrease the cooling liquid temperature to the first temperature; a pump for circulating the cooling liquid; and conduits to form a closed-circuit for the cooling liquid to pass continuously through the at least one heat exchanger and the at least one air cooler. A ratio of surface area of the at least one air cooler to the surface area of the at least one heat exchanger is optionally 12 or lower.

In embodiments of the apparatus, the ratio is optionally 9 or lower, optionally 6 or lower, or optionally 3 or lower.

In embodiments, the compressor compresses a gas in an air separation unit.

In embodiments of the apparatus, the surface area of the at least one heat exchanger and flow rate created by the pump is designed to result in a difference of temperature between the second temperature and first temperature being greater than 15° C. In other embodiments of the apparatus, the difference of temperature is at least 20° C., at least 25° C., or at least 30° C.

In embodiments of the apparatus, at least 2, at least 3, at least 5, at least 10, at least 15, at least 20 heat exchangers are used.

In embodiments of the apparatus, the at least one heat exchanger is a compressor intercooler or aftercooler.

The foregoing and other features of the invention and advantages of the present invention will become more apparent in light of the following detailed description of particular embodiments, as illustrated in the accompanying figures. As will be realized, the invention is capable of modifications in various respects, all without departing from the invention. Accordingly, the drawings and the description are to be regarded as illustrative in nature, and not as restrictive.

Figure 1:
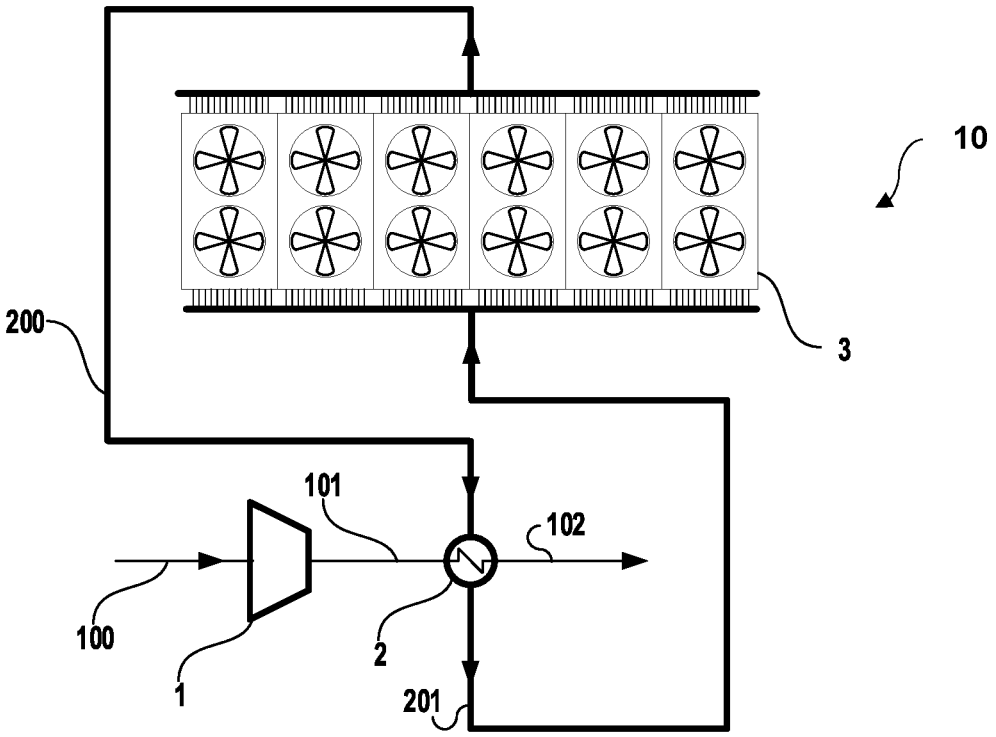
FIG. 1 is a schematic representation of an integrated closed-circuit cooling system according to the invention configured to supply cooling water to remove heat from a single source.

The apparatus and method of this invention will be described in detail with reference to the drawings.

Definitions

Prior to describing the invention in further detail, the terms used in this application are defined as follows unless otherwise indicated.

The term "closed-circuit" refers to any combination of conduits and devices that results in a circuit in which all or substantially all fluid recirculates through the circuit.

The term "surface area of the at least one air cooler" refers to surface area of heat transfer between air and cooling liquid.

The term "surface area of the at least one heat exchanger" refers to the surface area of heat transfer between cooling liquid and gas stream "Optional" or "optionally" means that the subsequently described circumstance may or may not occur, so that the description includes instances where the circumstance occurs and instances where it does not.

DETAILED DESCRIPTION OF THE INVENTION

Before the present invention is described in greater detail, it is to be understood that this invention is not limited to particular embodiments described, as such may, of course, vary. It is also to be understood that the terminology used herein is for the purpose of describing particular embodiments only, and is not intended to be limiting, since the scope of the present invention will be limited only by the appended claims.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Certain ranges are presented herein with numerical values being preceded by the term "about." The term "about" is used herein to provide literal support for the exact number that it precedes, as well as a number that is near to or approximately the number that the term precedes. In determining whether a number is near to or approximately a specifically recited number, the near or approximating unrecited number may be a number which, in the context in which it is presented, provides the substantial equivalent of the specifically recited number.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

It is noted that, as used herein and in the appended claims, the singular forms "a", "an", and "the" include plural referents unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

Disclosed is an apparatus including at least one heat exchanger in which a gas stream is cooled against a cooling liquid, whereby the cooling liquid temperature increases from a first temperature to a second temperature; at least one air cooler for cooling the cooling liquid after passing though the at least one heat exchanger, surface area of the at least one air cooler being designed to decrease temperature of the cooling liquid to the first temperature; a pump for circulating the cooling liquid; and conduits to form a closed-circuit for the cooling liquid to pass continuously through the at least one heat exchanger and the at least one air cooler. Also disclosed is a method in which the above apparatus is used. Further, disclosed is a system for using the above apparatus to cool a gas stream after the gas stream passes through at least one compressor.

An example of such a system including the above described apparatus is provided in FIG. 1.

Referring to FIG. 1, an integrated closed-circuit cooling system 10 is provided. Feed air stream 100 is compressed in compressor 1 and is discharged at a higher pressure as stream 101. Stream 101 is cooled against cooling water inlet stream 200 in process heat exchanger 2, resulting in stream 102. Stream 102 may be used as a feed stream in, for example, an air separation unit. The heat of compression is transferred to the cooling water, forming stream 201, which flows to the closed-circuit cooling liquid air cooler 3. The air cooler 3 rejects heat to the environment, lowering the temperature of the exiting cooling water to its initial value, stream 200.

A ratio of surface area of the at least one air cooler to the surface area of the at least one heat exchanger is optionally 12 or lower, optionally 9 or lower, optionally 6 or lower, or optionally 3 or lower.

Figure 2:
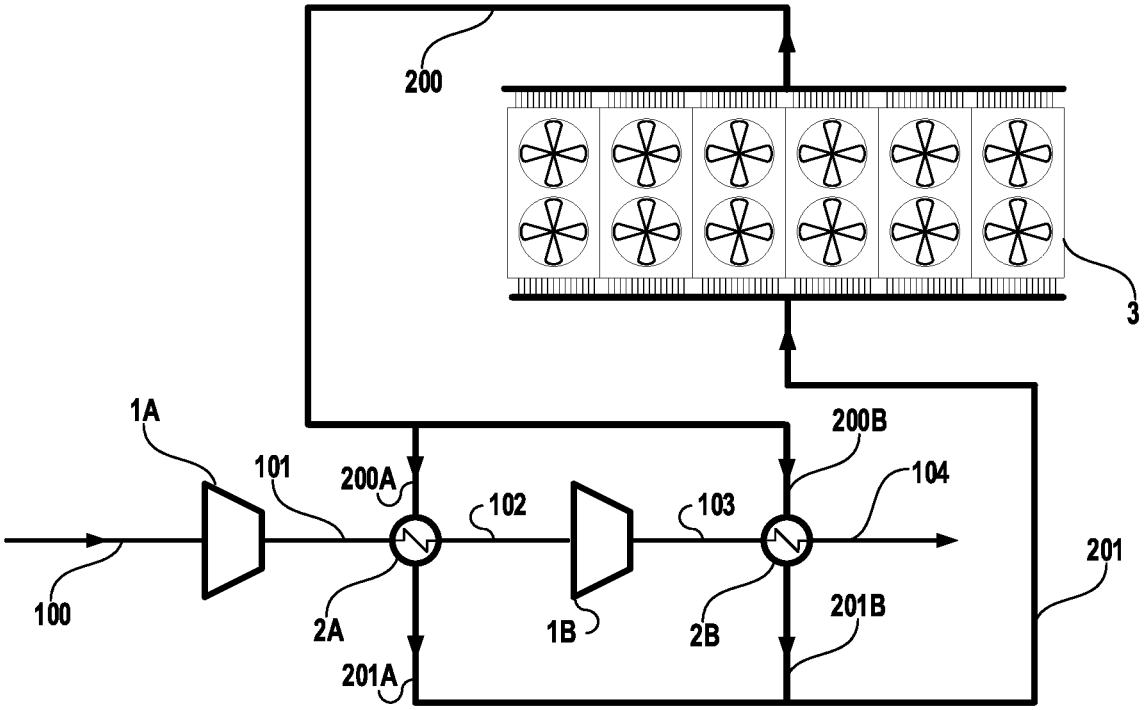
FIG. 2 is a schematic representation of an integrated closed-circuit cooling system according to the invention featuring a first and second heat exchange.

Referring now to FIG. 2, the feed air stream 100 is compressed in compressor 1A and is discharged at a higher pressure as stream 101. Cooling water stream 200 is split into cooling water stream 200A and cooling water stream 200B. Stream 101 is cooled against cooling water stream 200A in process heat exchanger 2A, resulting in stream 102.

Stream 102 is further compressed in compressor 1B to a higher pressure and is discharged at a higher pressure as stream 103. Stream 103 is cooled in process heat exchanger 2B against cooling water stream 200B, resulting in stream 104. Stream 104 may be used as a feed stream in, for example, an air separation unit. The heat of compression is transferred to the cooling water streams 200A and 200B, forming streams 201A and 201B, which combine to form stream 201 and flow to the closed-circuit cooling liquid air cooler 3.

The process heat exchangers 2A and 2B are designed in such a way as to minimize the temperature difference between streams 201A and 201B. The air cooler 3 rejects the heat of compression to the environment, lowering the temperature of the exiting cooling water to its initial value, stream 200.

The design of the integrated closed-circuit cooling system, however, is not limited to the exemplary design shown in FIGS. 1 and 2. It will be immediately apparent to the person of skill in the art that many other designs are possible, such as, and by way of example only, systems having air feed streams originating from two or more sources. These two or more air streams may combine and feed into a single compressor, or the two or more separate air feed streams may feed into two or more separate compressors. Each stream could include one or more process heat exchangers, and each of those heat exchangers could be incorporated into the closed-circuit cooling system by splitting the cooling liquid streams in a similar design as the system illustrated in FIG. 2. Also, similar to the system illustrated in FIG. 2, any number of cooling liquid streams can be combined to pass through the one or more cooling liquid air coolers.

The integrated design of the closed-circuit cooling liquid system and the one or more process exchangers is derived from an analysis of the added cost of increasing or decreasing the size of the closed-circuit cooling liquid air cooler and the one or more process heat exchangers. The temperature difference of cooling water inlet stream 200 and outflowing stream 201, known as the cooling water temperature rise, is a major contribution to the advantage of the process. The cooling water temperature rise has an impact on both the design of the process heat exchanger and the closed-circuit cooling liquid air cooler. For example, a design with a low cooling water temperature rise will result in small process coolers and a large closed-circuit cooling liquid air cooler.

For designs according to this invention, the ratio of surface area of the at least one air cooler to the surface area of the at least one heat exchanger is optionally 12 or lower, optionally 9 or lower, optionally 6 or lower, or optionally 3 or lower.

A person of skill in the art is aware that there is a limit to the upper cooling water temperature, because running processes with a hot discharge temperature have resulted in excessive water loss, corrosion, and fouling in the exchangers. Generally, closed-circuit systems exhibit substantially less water loss and fouling in the exchangers. And although there is an upper temperature limit for the closed system where there will be excessive loss, corrosion, and fouling, that temperature is substantially higher than in an open system.

Open systems allow the water to pour down large open air cooling towers where air cools the water as it falls, generally resulting in large amounts of lost water, which must be added with every pass of water through the system. Each time additional water is added, new minerals and other contaminants are added to the system, increasing the total amount of mineral and contaminants in the system, which leads to corrosion and fouling, especially when water is heated to higher temperatures.

In contrast, while minerals and other contaminants may be present initially in the water in a closed circuit system, additional minerals and other contaminants do not further increase over time within such a system because additional water is not added. Accordingly, a higher temperature in the cooling water does not cause increased corrosion and fouling in a closed system in the same way as in an open system.

Modeling systems are based typically on open systems, and accordingly, the models discourage large cooling water temperature increases. However, the inventors discovered that within the closed systems described herein, substantially higher temperature increases can lead to substantial overall system cost savings, even when adding the cost and power consumption of air coolers.

It was found that the cooling water temperature rises in the process according to the invention can be as much as 30° C. or more, a rise not comprehended by modelling systems generally known to the person of skill in the art. As the cooling water temperature rise increases, the circulating water flow decreases resulting in reduced power usage and an increased size of the process heat exchangers or intercoolers. However, the air cooler exchanger size decreases due to the increased heat transfer driving force between the cooling water and the ambient temperature. The power usage of the closed-circuit cooling liquid to drive the fans is proportional to the system size, thus surprisingly resulting in reduced power usage.

But there is a practical limit to how high the cooling water temperature in the closed-circuit cooling liquid system can be. The process air cooler size increases exponentially as the outlet cooling water temperature begins to approach the inlet process temperature. As this occurs, the heat exchanger size becomes prohibitively large from increasing the cooling water temperature rise. Thus, the proposed design scheme is to integrate the design of the two systems to lead to an optimal power reduction given heat exchanger size constraints.

Examples

By way of an example of the invention, a simulation of the process depicted in FIG. 2 has been carried out to demonstrate the reduction in power required to operate the cooling system.

Figure 3:
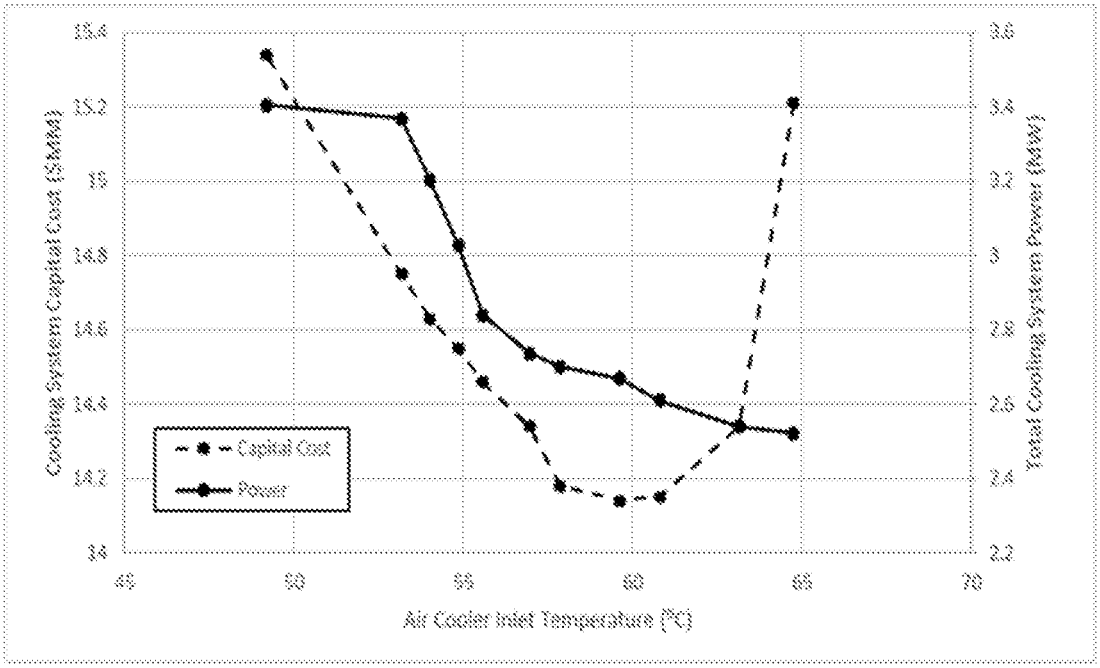
FIG. 3 shows cooling system capital cost and cooling system power as a function of air cooler inlet temperature for a system according to the invention.

A large, multi-train air separation unit complex which produces >9,000 tons per day of oxygen has been designed using both a standard cooling water temperature rise of 14° C. and a cooling water temperature rise of, for example, 26° C. according to an embodiment of the invention. This results in a closed-circuit cooling liquid (CCCL) air cooler inlet temperature of 49° C. and 61° C. respectively. A plant of this size requires about 144 MW of cooling duty. The compressor intercooler/aftercooler exchangers and the air cooler are designed using the HTRI X-changer software suite. The example shows that the process according to an embodiment of the invention leads to an overall reduction in power of over 25% and a decrease in heat transfer surface area for the combined cooling system. The reduction in power is a result of the reduced water pumping and the reduction in the number of fan units in the closed-circuit cooling liquid air cooler unit from 72 fans to 56 fans. This reduction is achieved by increasing the driving force for heat transfer between the cooling water and the air. The results are summarized in Table 1. FIG. 3 depicts the projected cooling system capital cost and cooling system power as a function of air cooler inlet temperature for the system according to the invention. At low air cooler inlet temperatures, the capital cost increases sharply because of the increased size and design of the air cooler necessary. Increasing the air cooler inlet temperature, and thus the cooling system temperature rise, results in a decrease in overall cost. As the air cooler inlet temperature continues to increase, the capital cost increases due to the excessively large intercooler and/or aftercooler sizes required. Thus, the design ratios of the instant invention fall between these two extremes.

TABLE 1

| | Temp Rise | Air Cooler Inlet Temp | Total Intercooler/ Aftercooler Exchanger SA ($m^2$) | Air Cooler SA ($m^2$) | Water Flow (Kg/s) | Air Cooler Power (KW) |
|---|---|---|---|---|---|---|
| Standard | 14° C. | 49° C. | 47,500 | 705,000 | 2,400 | 2,775 |
| Example 1 | 20° C. | 55° C. | 53,000 | 610,000 | 1,670 | 2,580 |
| Example 2 | 23° C. | 58° C. | 69,000 | 565,000 | 1,425 | 2,490 |
| Example 3 | 26° C. | 61° C. | 89,000 | 530,000 | 1,250 | 2,275 |
| Example 4 | 30° C. | 65° C. | 175,000 | 500,000 | 1,050 | 2,225 |

Other ratios, less dependent on plant size, such as water flow rate, air cooler or exchanger surface area, and pump or fan power, each divided by total plant cooling duty (heat rejected to atmosphere) may prove useful as design tool and for comparison to conventional systems. For designs according to embodiments of this invention, the ratio of cooling water flow to cooling duty is less than 12 kg/MJ, or is less than 9 kg/MJ, and is more than 6 kg/MJ. In other embodiments, the ratio of air cooler surface area to cooling duty is less than 4500 $m^2$/MW, or is less than 3500 $m^2$/MW, and is more than 3000 $m^2$/MW. In yet other embodiments, the ratio of intercooler or aftercooler exchanger surface area to cooling duty is more than 350 $m^2$/MW, or is more than 600 $m^2$/MW, and is less than 1300 $m^2$/MW.

Preferred embodiments of this invention are described herein, including the best mode known to the inventors for carrying out the invention. It will be appreciated that the invention is not restricted to the details described above with reference to the preferred embodiments but that numerous modifications and variations can be made without departing from the spirit and scope of the invention as defined by the following claims.

What is claimed is:

1. An apparatus for cooling a gas stream comprising:

at least one heat exchanger configured to cool the gas stream via a cooling liquid such that a temperature of the cooling liquid increases from a first temperature to a second temperature, the cooling liquid comprising water;

conduits connected between at least one air cooler and the at least one heat exchanger such that the at least one air cooler is arranged and positioned to receive the cooling liquid output from the at least one heat exchanger to cool the cooling liquid from the second temperature to the first temperature and feed the cooling liquid at the first temperature to the at least one heat exchanger in a closed-circuit, the at least one air cooler having a surface area to decrease the temperature of the cooling liquid from the second temperature to the first temperature so that the cooling liquid at the second temperature that is received by the at least one air cooler is cooled to the first temperature for feeding the cooling liquid at the first temperature to the at least one heat exchanger;

wherein a ratio of the surface area of the at least one air cooler to a surface area of the at least one heat exchanger is 12 or lower; and wherein a difference of temperature between the second temperature and the first temperature is greater than 15° C.

2. The apparatus according to claim 1, wherein the ratio is between 12 and 3.

3. The apparatus according to claim 2, wherein the ratio is between 12 and 6.

4. The apparatus according to claim 1, wherein the difference of temperature between the second temperature and the first temperature is also not more than 30° C.

5. The apparatus according to claim 1, wherein the difference of temperature is at least 20° C.

6. The apparatus according to claim 5, wherein the difference of temperature is at least 25° C.

7. The apparatus according to claim 6, wherein the difference of temperature is at least 30° C.

8. The apparatus according to claim 1, wherein the at least one heat exchanger comprises at least two heat exchangers; and wherein the first temperature of the cooling liquid is measurable at an outlet of the at least one air cooler; and wherein the second temperature of the cooling liquid is measurable at an inlet of the at least one air cooler.

9. The apparatus according to claim 1, wherein the at least one heat exchanger is a compressor intercooler or aftercooler.

10. A method for cooling a gas stream comprising:

cooling the gas stream via at least one heat exchanger in which the gas stream is cooled against a cooling liquid to increase a temperature of the cooling liquid from a first temperature to a second temperature;

passing the cooling liquid between the at least one heat exchanger and at least one air cooler in a closed-circuit that includes:

outputting the cooling liquid from the at least one heat exchanger to feed the cooling liquid at the second temperature to the at least one air cooler;

cooling the cooling liquid from the second temperature to the first temperature via the at least one air cooler after the cooling liquid is output from the at least one heat exchanger; and outputting the cooling liquid at the first temperature from the at least one air cooler to feed the cooling liquid to the at least one heat exchanger;

wherein a difference of temperature between the second temperature and the first temperature is greater than 15° C. and a ratio of the surface area of the at least one air cooler to a surface area of the at least one heat exchanger is 12 or lower; and wherein the cooling liquid comprises water.

11. The method according to claim 10, wherein the difference of temperature is at least 20° C.

12. The method according to claim 11, wherein the difference of temperature is at least 25° C.

13. The method according to claim 10, wherein the difference of temperature is also not more than 30° C.

14. The method according to claim 10, wherein the ratio is between 12 and 3.

15. The method according to claim 10, wherein the ratio is 6 or lower.

16. The method according to claim 10, wherein the at least one heat exchanger comprises at least two heat exchangers; and wherein the first temperature of the cooling liquid is measurable at an outlet of the at least one air cooler; and wherein the second temperature of the cooling liquid is measurable at an inlet of the at least one air cooler.

17. The method according to claim 10, wherein the at least one heat exchanger is a compressor intercooler or aftercooler.

18. A system for cooling a gas stream comprising:

at least one compressor to compress the gas stream;

at least one heat exchanger in which the gas stream compressed in the at least one compressor is cooled against a cooling liquid such that a temperature of the cooling liquid increases from a first temperature to a second temperature;

at least one air cooler connected to the at least one heat exchanger in a closed-circuit for the cooling liquid to cool the cooling liquid after the cooling liquid passes though the at least one heat exchanger to decrease the temperature of the cooling liquid from the second temperature to the first temperature and feed the cooling liquid at the first temperature to the at least one heat exchanger; and wherein the cooling liquid comprises water and a ratio of surface area of the at least one air cooler to the surface area of the at least one heat exchanger is 12 or lower; and wherein a difference of temperature between the second temperature and the first temperature is greater than 15° C.

19. The system according to claim 18, wherein the ratio is 6 or lower.

20. The system according to claim 18, wherein the ratio is between 12 and 3.

21. The system according to claim 18, wherein the difference of temperature between the second temperature and the first temperature is not more than 30° C.

22. The system according to claim 18, wherein the difference of temperature is at least 20° C.

23. The system according to claim 22, wherein the difference of temperature is at least 25° C.

24. The system according to claim 23, wherein the difference of temperature is at least 30° C.

25. The system according to claim 18, wherein the at least one heat exchanger comprises at least two heat exchangers; and wherein the first temperature of the cooling liquid is measurable at an outlet of the at least one air cooler; and wherein the second temperature of the cooling liquid is measurable at an inlet of the at least one air cooler.

26. The system according to claim 18, wherein the at least one heat exchanger is a compressor intercooler or aftercooler.

* * * * *